US010364083B2

(12) United States Patent
Akaogi et al.

(10) Patent No.: US 10,364,083 B2
(45) Date of Patent: Jul. 30, 2019

(54) BREAK-OFF SPOUT, POUCH HAVING A BREAK-OFF SPOUT, PRODUCTION METHOD FOR POUCH HAVING A BREAK-OFF SPOUT, FOOD OR BEVERAGE IN POUCH HAVING A BREAK-OFF SPOUT, AND PRODUCTION METHOD THEREFOR

(71) Applicant: ORIHIRO ENGINEERING CO., LTD., Tomioka-shi (JP)

(72) Inventors: Takahiro Akaogi, Hiratsuka (JP); Masataka Tsuruta, Tomioka (JP); Yuu Koyama, Tokyo (JP)

(73) Assignee: Orihiro Engineering Co., Ltd., Tomioka-shi, Gunma (JP)

( * ) Notice: Subject to any disclaimer, the term of this patent is extended or adjusted under 35 U.S.C. 154(b) by 695 days.

(21) Appl. No.: 14/916,131

(22) PCT Filed: Sep. 2, 2014

(86) PCT No.: PCT/JP2014/073001
§ 371 (c)(1),
(2) Date: Mar. 2, 2016

(87) PCT Pub. No.: WO2015/033912
PCT Pub. Date: Mar. 12, 2015

(65) Prior Publication Data

US 2016/0200487 A1 Jul. 14, 2016

(30) Foreign Application Priority Data

Sep. 3, 2013 (JP) ..... 2013-182327

(51) Int. Cl.
*B65D 75/58* (2006.01)
*B65B 61/00* (2006.01)
(Continued)

(52) U.S. Cl.
CPC ..... *B65D 75/5883* (2013.01); *B65B 3/045* (2013.01); *B65B 55/022* (2013.01);
(Continued)

(58) Field of Classification Search
CPC .... B65D 75/5883; B65D 47/36; B65B 3/045; B65B 55/24; B65B 55/022; B65B 61/186; B65B 61/10
See application file for complete search history.

(56) References Cited

U.S. PATENT DOCUMENTS

2009/0140008 A1 6/2009 Welp

FOREIGN PATENT DOCUMENTS

JP 11-035051 A 2/1999
JP 2007-091233 A 4/2007
(Continued)

*Primary Examiner* — Andrew T Kirsch
*Assistant Examiner* — Don M Anderson
(74) *Attorney, Agent, or Firm* — Knobbe, Martens, Olson & Bear, LLP

(57) ABSTRACT

The break-off spout of the present invention includes: a spout main body (110) having a break-off section (150) formed via a weakened section (121) such that an annular section (152) having a through-hole formed therein protrudes to the tip side; and a pair of left and right cover members (160) integrally formed with the spout main body (110) via hinge sections provided below the weakened section (121). The pair of left and right cover members (160) are formed in a shape such that, when the cover members are engaged with each other, the cover members cover a portion of the spout main body (110) above the hinge sections including the break-off section (150). An insertion port (164) through which deformation means that deforms the annular section (152) and blocks the through-hole can be inserted is provided in the cover members (160).

17 Claims, 7 Drawing Sheets

(51) Int. Cl.

| | |
|---|---|
| ***B65D 47/36*** | (2006.01) |
| ***B65B 55/02*** | (2006.01) |
| ***B65B 55/24*** | (2006.01) |
| ***B65B 61/18*** | (2006.01) |
| ***B65B 3/04*** | (2006.01) |

(52) U.S. Cl.
CPC ..... *B65B 55/24* (2013.01); *B65B 61/00* (2013.01); *B65B 61/186* (2013.01); *B65D 47/36* (2013.01)

(56) References Cited

FOREIGN PATENT DOCUMENTS

| | | | |
|---|---|---|---|
| JP | 2008-007165 | A | 1/2008 |
| JP | 2006-062752 | A | 3/2009 |
| JP | 2009-046184 | A | 3/2009 |
| JP | 2010-018319 | A | 1/2010 |
| JP | 2011-212448 | A | 10/2011 |
| JP | 2013-060213 | A | 4/2013 |
| JP | 2013-154897 | A | 8/2013 |
| WO | 2014/073269 | A | 5/2014 |

BREAK-OFF SPOUT, POUCH HAVING A BREAK-OFF SPOUT, PRODUCTION METHOD FOR POUCH HAVING A BREAK-OFF SPOUT, FOOD OR BEVERAGE IN POUCH HAVING A BREAK-OFF SPOUT, AND PRODUCTION METHOD THEREFOR

CROSS-REFERENCE TO RELATED APPLICATIONS

This application is the U.S. National Phase under 35. U.S.C. § 371 of International Application PCT/JP2014/073001, filed Sep. 2, 2014, which claims priority to Japanese Patent Application No. 2013-182327, filed Sep. 3, 2013. The disclosures of the above-described applications are hereby incorporated by reference in their entirety.

TECHNICAL FIELD

The present invention relates to a break-off spout in which the tip of a channel is closed by a break-off section that is formed integrally with a spout main body, and more particularly relates to a break-off spout in which the spout main body and break-off section are protected by a cover that covers the outer periphery of the spout main body, a pouch having the break-off spout, a method of producing the pouch having the break-off spout, a food or beverage enclosed in the pouch having the break-off spout and a method of producing a food or beverage enclosed in the pouch.

BACKGROUND ART

A break-off spout known in the prior art has a spout main body provided with a tube having a channel that passes through its center, the tip of the channel being closed by a break-off section that is formed integrally on the tip of the tube.

In addition, it is also know that, for hygiene purposes, a break-off spout is provided with a cover that covers the periphery of the tip side of the tube of the spout main body to prevent fingers from directly contacting the spout main body, and moreover that improves the convenience of the user by enabling the operation of removing the cover to be carried out at the same time as the operation of detaching the break-off section (for example, refer to Patent Documents 1 and 2).

Still further, it is also known that, in order to simplify production and assembly (for example, refer to Patent Document 3), the break-off spout has a cover which is integrated with the spout main body.

In known break-off spouts such as described in Patent Documents 1 and 2, the covers (cap 12 and cap 3) are parts that are distinct from the spout main bodies (opening 10 and spout 2), thereby adding to the number of parts and increasing the number of production and assembly steps. In addition, because these are constructions in which the covers (cap 12 and cap 3) are placed and secured onto the break-off sections (twist-off protrusion 18 and sealing member 15) and because force is consequently applied when putting on the covers (cap 12 and cap 3), the problem arises that the weakened sections (thin-walled portion 24 and thin-walled portion 16) may be damaged with a resulting loss of sealing performance.

Finally, if external force is applied to the covers (cap 12 and cap 3) during transport or storage, there is concern that force will be applied to the break-off sections (twist-off protrusion 18 and sealing member 15) causing damage to weakened sections (thin-walled portion 24 and thin-walled portion 16) and the consequent loss of sealing performance.

In the known break-off spout such as described in Patent Document 3, the cover (lid member 20) is integral to the spout main body (spout member 10), thereby facilitating production and assembly. However, because the cover (lid member 20) is formed as a single body via the break-off section (sealing member 3), the concern arises that force will be applied to the break-off section (sealing member 3) at the time of assembling the cover (lid member 20), causing damage to weakened section (the connection of sealing member 3 and tube 4) and a resulting loss of sealing performance.

In addition, because a portion of the break-off section (sealing member 3) is exposed outside the cover (lid portion 20), there is concern that external force will be applied directly to the break-off section (sealing member 3) during transport or storage, causing damage to weakened section (the connection of sealing member 3 and tube 4) and a resulting loss of sealing performance.

Further, the concern remains that when external force is applied to the cover (lid member 20), force will be applied via the hinge section (connecting section 5) to the break-off section (sealing member 3), causing damage to the weakened section (the connection of sealing member 3 and tube 4) and a resulting loss of the sealing performance.

Finally, because the break-off sections (protrusion for twist-off 18, sealing member 15, and sealing member 3) are closed off from the start in these known break-off spouts, the problems arise that the spouts are difficult to clean after production and that contents cannot be sufficiently packed into the spout.

LITERATURE OF THE PRIOR ART

Patent Documents

Patent Document 1: JP 2006-62752
Patent Document 2: JP 2009-46184
Patent Document 3: JP 2010-18319

SUMMARY OF THE INVENTION

The present invention provides a solution to the problems of the known break-off spouts such as described hereinabove. One object is to prevent damage to weakened section and a resulting loss of sealing performance at the time of assembly, transport, and storage while both facilitating production and assembly and improving convenience for the user. The present invention further has the object of providing a break-off spout, a pouch having the break-off spout a production method of the pouch having the break-off spout, a food or beverage in the pouch having the break-off spout, and a production method of the food or beverage in the pouch having the break-off spout that facilitate the cleaning process and that allow adequate packing of contents into the spout.

According to one aspect of the present invention, a break-off spout comprises:

a spout main body having a tube having a channel that passes through its center and a break-off section that is formed at a tip of the tube via a weakened section and that is integrated with the tube, a tip of the channel being closed by the break-off section; and a cover that covers an outer periphery of the tube of the spout main body at a tip side of the tube; wherein a protruding annular section is provided at a tip side of the break-off section;

a through-hole is formed in the annular section, wherein the through-hole communicates with the channel and is open at a tip side of the annular section;

the cover consists of a pair of cover members that are formed in a state in which the cover members are divided into left and right parts, and each of the cover members is integrated with the spout main body via a hinge section that is provided below the weakened section;

the pair of cover members are both provided with engagement parts that mutually engage and secure with each other, and the cover members are formed in a shape to cover a portion of the spout main body when cover members are folded upward and secured to each other to form a unified cover, the portion being above the hinge sections and including the break-off section; and insertion ports are provided at tip sides of the pair of cover members, wherein the insertion ports allow insertion of deformation means that deforms the annular section and blocks the through-hole.

According to one aspect of the break-off spout, a pair of cover members is integrated with the spout main body via hinge sections that are provided below the weakened section. As a result, no force is applied to the break-off section or the weakened section when the pair of cover members are bent upward to engage with each other at the time of assembly, whereby damage to the weakened section is prevented and sealing performance is not lost.

In addition, the cover members are formed in a shape to cover a portion of the spout main body when cover members are folded upward and secured to each other to form a unified cover, the portion being above the hinge sections and including the break-off section. In this way, direct force is not applied from the outside upon the break-off section or weakened section at the time of transport or storage and damage to the weakened section due to unintentional external force can be prevented.

Still further, at a tip side of the annular section, a through-hole that communicates with the channel and that is open at a tip side of the annular section is formed and a protruding annular section is provided. Insertion ports are provided at tip sides of the pair of cover members, wherein the insertion ports allow insertion of deformation means that deforms the annular section and blocks the through-hole. By means of this configuration, the through-hole can be blocked following the completion of all processes after production, thus allowing cleaning of the interior of the spout to be carried out easily, and further, allowing closing of the through-hole after contents have been packed to enable packing to be carried out without leaving any space in the spout.

Finally, because the annular section is also covered by the cover, the protruding annular section is not subjected to direct force, and damage to weakened sections due to unintentional external force can therefore be prevented.

EXPLANATION OF REFERENCE NUMBERS

Figure 1:
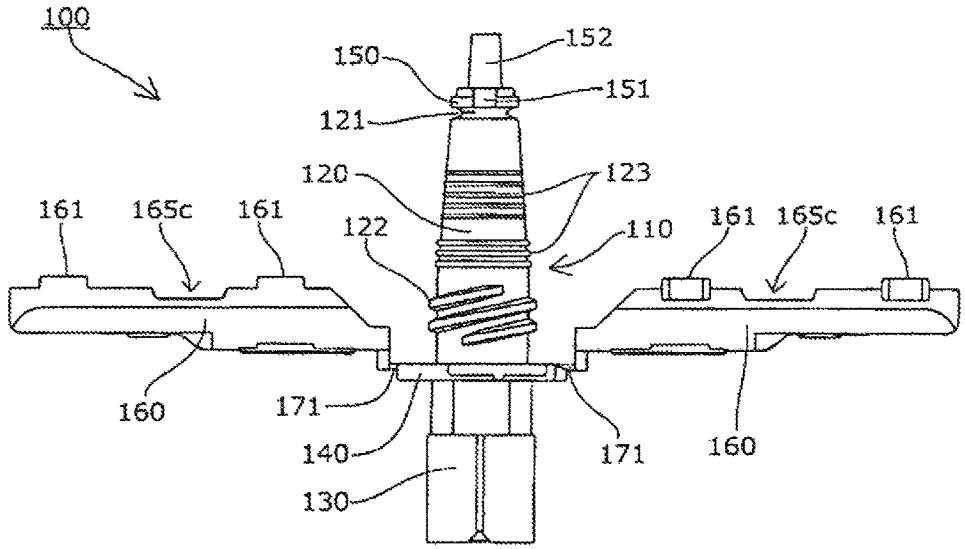
FIG. 1 is a front view before assembly of the break-off spout that is an exemplary embodiment of the present invention.

100 break-off spout
110 spout main body
111 channel
120 tube
121 weakened section
122 screw section
130 attachment section
140 flange section
150 break-off section
151 actuator arm
152 annular section
153 through-hole
160 cover member
161 engagement part
162 stepped section (proximate protruding part)
163 accommodation recess
164 insertion port
165 cleaning fluid flow port
166 top opening
167 pressure rib
171 connecting section (hinge section)

EMBODIMENT FOR CARRYING OUT THE INVENTION

The break-off spout, the pouch having the break-off spout, and the production method of the pouch of an exemplary embodiment of the present invention are next described, but the specific shape, construction, and materials may take any form as long as damage to the weakened section and the consequent loss of sealing performance at the time of assembly, transport, or storage are prevented, and further, cleaning processes are facilitated and adequate packing of the contents to the interior of the spout is enabled while facilitating the production and assembly of the break-off spout of the present invention and improving the convenience of the user.

In addition, the specific shape, construction, and materials of the pouch having the break-off spout of the present invention may take any form as long as its spout is the previously described break-off spout.

The specific steps of the production method of the pouch having the spout of the present invention may be any method as long as, after cleaning the interior of the channel of the break-off spout, deformation means is inserted from an insertion port to deform an annular section and block the through-hole.

Further, contents that have been disinfected and/or sterilized in advance by a known method are shown by way of example as the contents that are packed into the pouch having the spout of the present invention, and such contents that can be shown as examples include a food or beverage, a pharmaceutical, a cosmetic, a cleaning material, and agricultural chemicals. Of these, a food or beverage that requires hygienic handling is suitable, a liquid food is more preferable, and food or beverage for which hygienic handling is required such as a nutritional food, a liquid food, or a nursing food is even more preferable.

The configuration of break-off spout 100 of an exemplary embodiment of the present invention is next described based on the figures.

Figure 2:
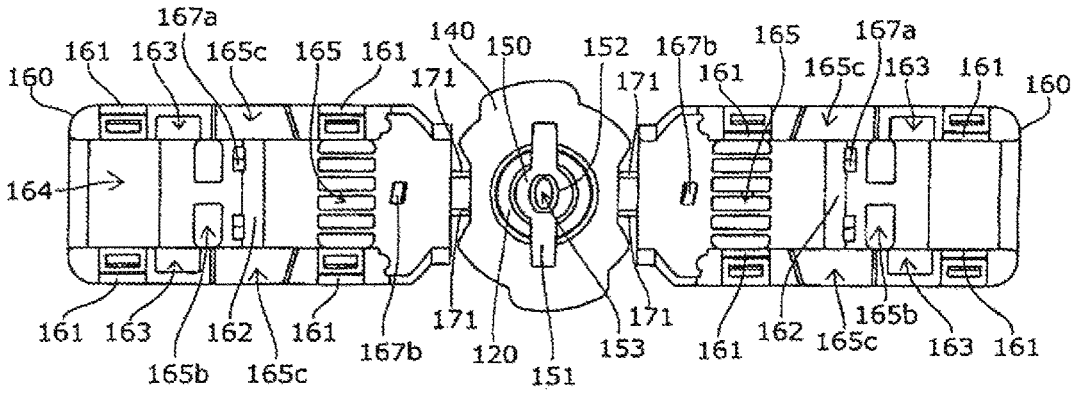
FIG. 2 is a plan view before assembly of the break-off spout that is an exemplary embodiment of the present invention.
Figure 3:
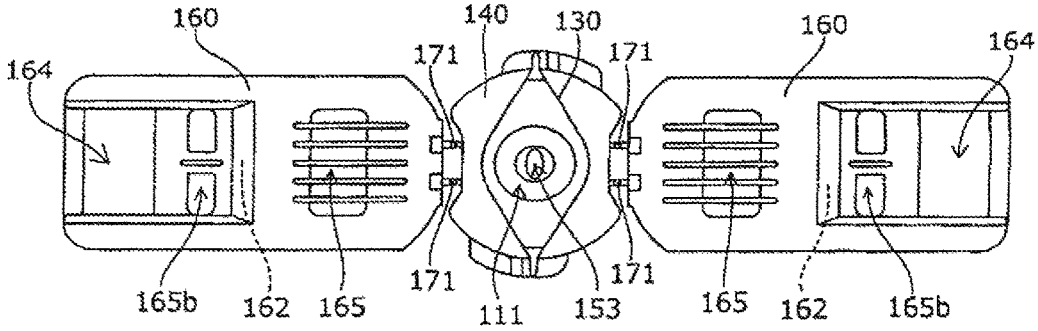
FIG. 3 is a bottom view before assembly of the break-off spout that is an exemplary embodiment of the present invention.
Figure 4:
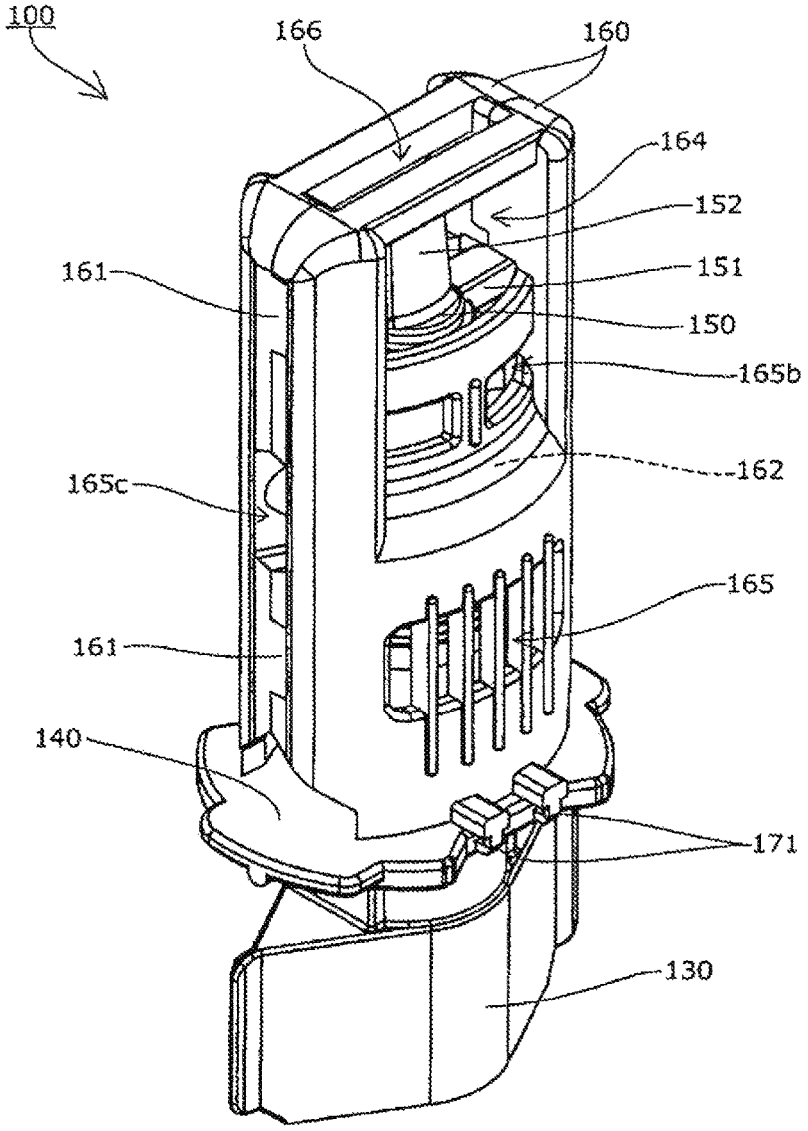
FIG. 4 is a perspective view following assembly of the break-off spout that is an exemplary embodiment of the present invention.
Figure 5:
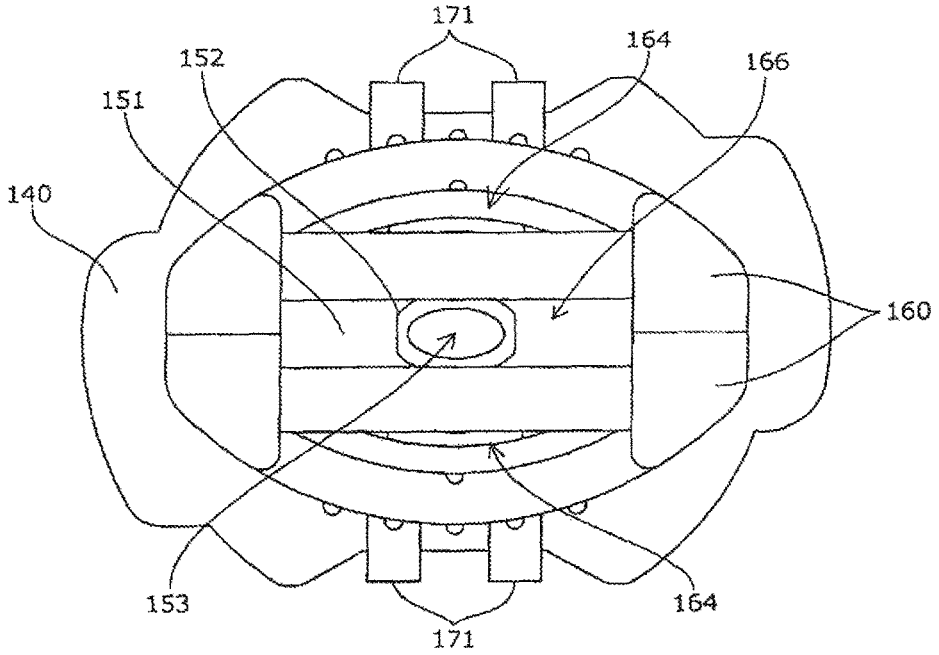
FIG. 5 is a plan view following assembly of the break-off spout that is an exemplary embodiment of the present invention.

As shown in FIGS. 1 to 3 (the state before assembly) and FIGS. 4 to 9 (the state following assembly), break-off spout 100 of an exemplary embodiment of the present invention consists of spout main body 110 and a pair of left and right cover members 160 that are connected to spout main body 110 by connecting sections 171 that are hinge sections. Spout main body 110 and the pair of cover members 160 are formed as a single body in the shape that precedes assembly shown in FIGS. 1 to 3 by a method such as injection molding.

Spout main body 110 consists of tube 120, break-off section 150 that is formed as a single body from the tip of tube 120 via weakened section 121, attachment section 130 that is attached to a container such as a pouch, and flange section 140 that is provided in the vicinity of the upper portion of attachment section 130. Channel 111 is provided in the center of spout main body 110.

Annular section 152 is provided so as to protrude on the tip side of break-off section 150, and through-hole 153 that communicates with channel 111 and that is also open on the tip side is formed inside annular section 152.

In addition, break-off section 150 has a pair of actuator arms 151 that extend in a direction orthogonal to channel 111, and moreover, in a direction orthogonal to the pair of left and right cover members 160 (the forward-backward direction in FIG. 1 and the vertical direction in FIGS. 2 and 3). By twisting these actuator arms 151, weakened section 121 is broken, break-off section 150 is broken off from tube 120, and the tip of channel 111 is opened.

On the peripheral surface of tube 120, screw section 122 is provided for connecting an attachment such as a tube at the time of use, and further, ring-shaped protrusions 123 are formed as appropriate for close adhesion and locking of, for example, a tube based on the purpose for which it is to be used.

The pair of right and left cover members 160 are formed as a single body via two connecting sections 171 that are provided on flange section 140 of spout main body 110.

As will be explained hereinbelow, connecting sections 171 act as hinge sections at the time of assembly, and during use are broken to cause separation of cover members 160 from spout main body 110.

On each of cover members 160, engagement parts 161 are provided to mutually engage to form a unified cover at the time of assembly.

When cover members 160 are secured to each other to form a unified cover as shown in FIGS. 4 to 9, cover members 160 are formed in a shape that covers tube 120 and break-off section 150 that are above connecting sections 171 of spout main body 110.

As shown in FIGS. 1 to 9, on the tip side of each of cover members 160, insertion port 164 is provided into which deformation means (not shown) that deforms annular section 152 and blocks through-hole 153 can be inserted from both sides when cover members 160 are secured to each other to form a unified cover. Further, cover members 160 are formed in a shape to form top opening 166.

Each of cover members 160 has cleaning fluid flow port 165 below insertion port 164.

The present exemplary embodiment includes large cleaning fluid low ports 165 at a position close to connecting section 171 as well as small cleaning fluid flow ports 165*b* and cleaning fluid, flow port 165*c* at a position close to insertion port 164. Cleaning fluid flow ports 165*c* are formed on the surfaces that come together when the covers are secured to each other to form a unified cover.

In addition, the inner circumferential surfaces of cover members 160 are formed in shapes having stepped sections 162.

Pressure ribs 167*a* are provided as proximate protruding parts directly above this stepped section 162 so as to protrude toward the inner circumference. By being in contact or in proximity to the outer peripheral surface of tube 120 when cover members 160 are secured to each other to form a unified cover, cover members 160 are secured immobile or with only slight movement to spout main body 110 and thus make absolutely no contact with break-off section 150.

In addition, pressure ribs 167*b* are also provided so as to protrude inward in the portions of each of cover members 160 that face screw section 122 that is provided on the outer peripheral surface of tube 120. When cover members 160 are secured to each other to form a unified cover, pressure ribs 167*b* come into contact with or proximity to screw section 122 of tube 120 to act as proximate protruding parts.

In the present exemplary embodiment, pressure ribs 167*b* are formed so as to enter into the troughs of screw section 122, and can restrain the vertical movement of cover members 160 that form a unified cover.

Figure 6:
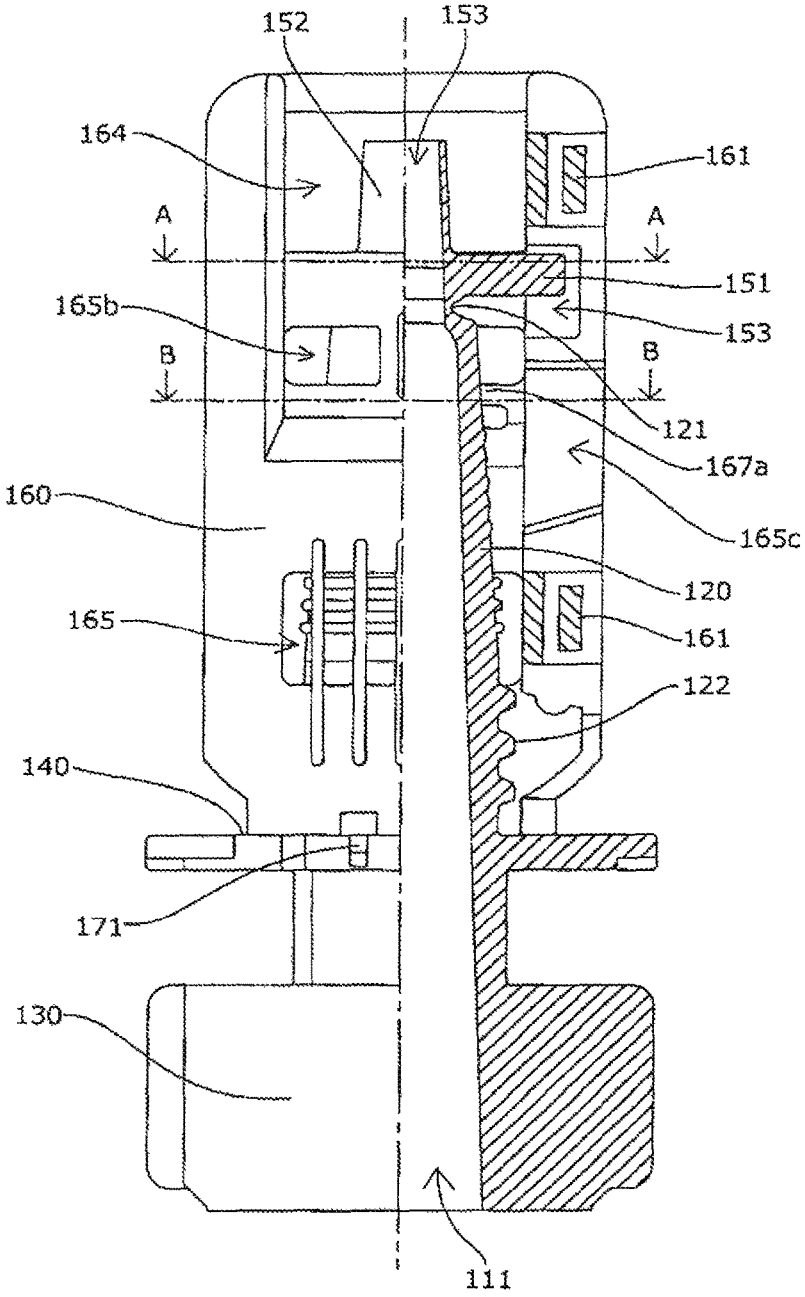
FIG. 6 is a side half-sectional view following assembly of the break-off spout that is an exemplary embodiment of the present invention.
Figure 7:
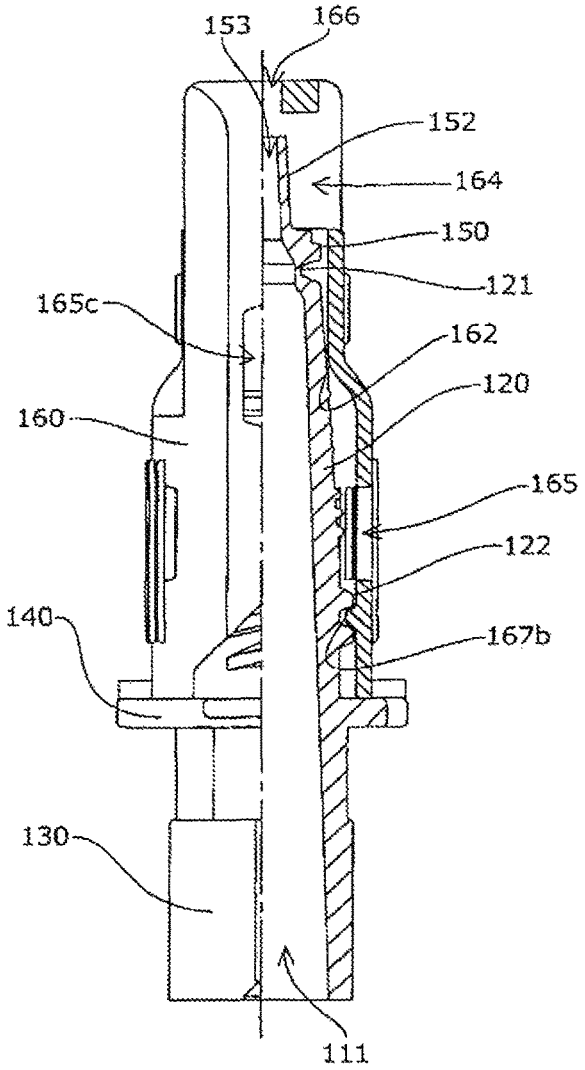
FIG. 7 is a front half-sectional view following assembly of the break-off spout that is an exemplary embodiment of the present invention.
Figure 8:
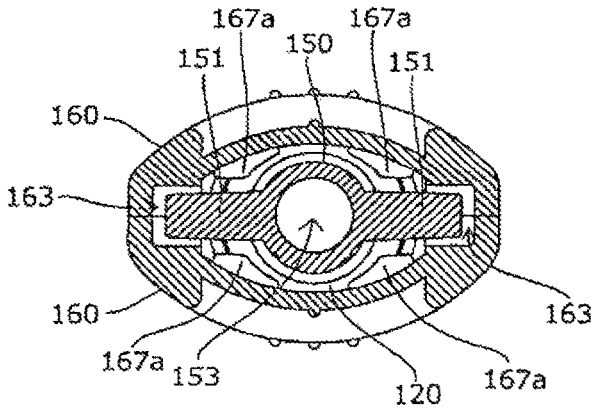
FIG. 8 is a sectional view taken along line A-A of FIG. 6.
Figure 9:
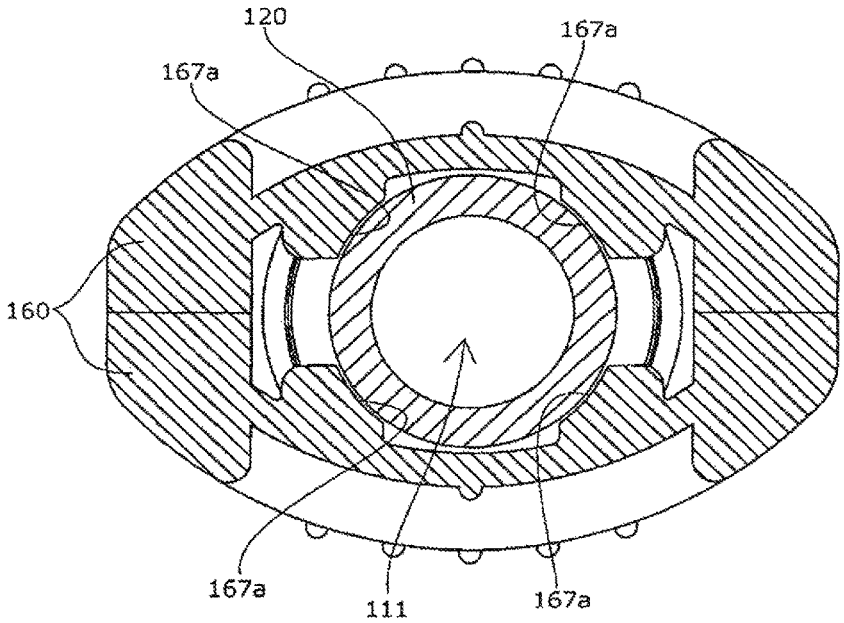
FIG. 9 is a sectional view taken along line B-B of FIG. 6.

In addition, accommodation recesses 163 that accommodate actuator arms 151 of break-off section 150 are provided on each of cover members 160 as shown in FIG. 6 and FIG. 8. Accommodation recesses 163 are formed in a shape that encloses actuator arms 151 with gaps in each of the vertical directions and the peripheral directions of spout main body 110 when cover members 160 are secured to each other to form a unified cover.

The operation and action of break-off spout 100 are next described.

As shown in FIGS. 1 to 3, break-off spout 100 is produced by, for example, injection molding in a state in which the pair of right and left cover members 160 extend horizontally to the right and left.

From this state, the unit is assembled by folding the pair of right and left cover members 160 upward by bending with connecting sections 171 as, hinge sections, whereby each of engagement parts 161, that face each other, engage each other to be secured to each, other and thus form a unified cover.

Following assembly, since connecting sections 171 are in a bent state, the pair of left and right cover members 160 that are engaged and secured to each other to form a unified cover are in a state of covering spout main body 110 above connecting sections 171 including annular section 152 above break-off section 150 as shown in FIGS. 4 to 7.

At this time, as shown in FIGS. 6 to 9, break-off section 150 and tube 120 of spout main body 110 are in a state in which there are gaps between break-off section 150/tube 120 and the inner circumferential surfaces of cover members 160, with the exceptions of pressure ribs 167*a*, pressure ribs 167*b*, stepped sections 162, and screw section 122.

In addition, actuator arms 151 of break-off section 150 also have predetermined gaps in each of the peripheral directions and vertical directions and are in a state of enclosure in accommodation recesses 163 of cover members 160.

In this state, through-hole 153 of annular section 152 communicates with channel 111 and is open upward and downward, whereby cleaning of channel 111 inside spout main body 110 can be easily carried out.

In addition, after having been welded to a pouch, spout 100 may be cleaned together with the pouch interior, and the pouch interior can be filled with content from opened through-hole 153.

After channel 111 in spout main body 110 is cleaned (or after channel 111 is filled with content from through-hole 153), deformation means (not shown in the figure) that deforms annular section 152 is inserted from insertion port 164 to block through-hole 153. In this case, a specific example of the deformation means that can be offered is blockage realized by heat.

The insertion of this deformation means may be realized at the same time as bonding of the remaining parts of the pouch, and in this case, the production steps of the pouch can be simplified.

Subsequently, the outer periphery of spout main body 110 and the inner circumference of cover members 160 are cleaned.

At this time, an adequate flow of cleaning fluid can be ensured and effective cleaning can be carried out due to the inclusion of insertion port 164, top opening 166, large cleaning fluid flow ports 165 in the vicinity of connecting sections 171, small cleaning fluid flow ports 165*b* in the vicinity of insertion port 164, and further, cleaning fluid flow ports 165*c* that are formed on the matching surfaces when cover members 160 are secured together to form a unified cover.

On the other hand, during the operation of assembling spout 100, if one of cover members 160 should bend greatly when the pair of right and left cover members 160 are bent upwards, the provision of pressure ribs 167*a*, pressure ribs 167*b*, stepped sections 162, and screw section 122, which are proximate protruding parts, limits the movement of cover members 160 regardless of the direction of cover members 160, and as a result, no contact with break-off section 150 occurs, no pressure is applied to break-off section 150 or weakened section 121, and damage to weakened section 121 is prevented.

In addition, despite the unintentional application of external force to cover members 160 during transport or storage of the spout alone or the pouch, receptacle following assembly, the pair of cover members 160 that have been fixed to each other to make up a unified cover are firmly fixed to spout main body 110 or are only very slightly movable. Break-off section 150 or weakened section 121 therefore do not contact cover members 160, and as a result, not only is damage to weakened section 121 prevented but loss of sealing performance following packing and sealing of contents does not occur.

When using break-off spout 100 that has been assembled in this way, the user breaks connecting section 171 by simply twisting the pair of cover members 160 that have been secured together to form a unified cover. With this action, actuator arms 151 of break-off section 150 that are enclosed in accommodation recesses 163 of cover members 160 also receive force in, the direction of twisting, whereby break-off section 150 is twisted and weakened section 121 is also broken.

In addition, pressure ribs 167*b* are formed so as to enter into the troughs of screw section 122. As a result, when the pair of cover members 160 that form the unified cover are twisted, pressure ribs 167*b* receive upward force along the screw ridges of screw section 122 and therefore can more easily break connecting section 171 and weakened section 121.

Figure 10:
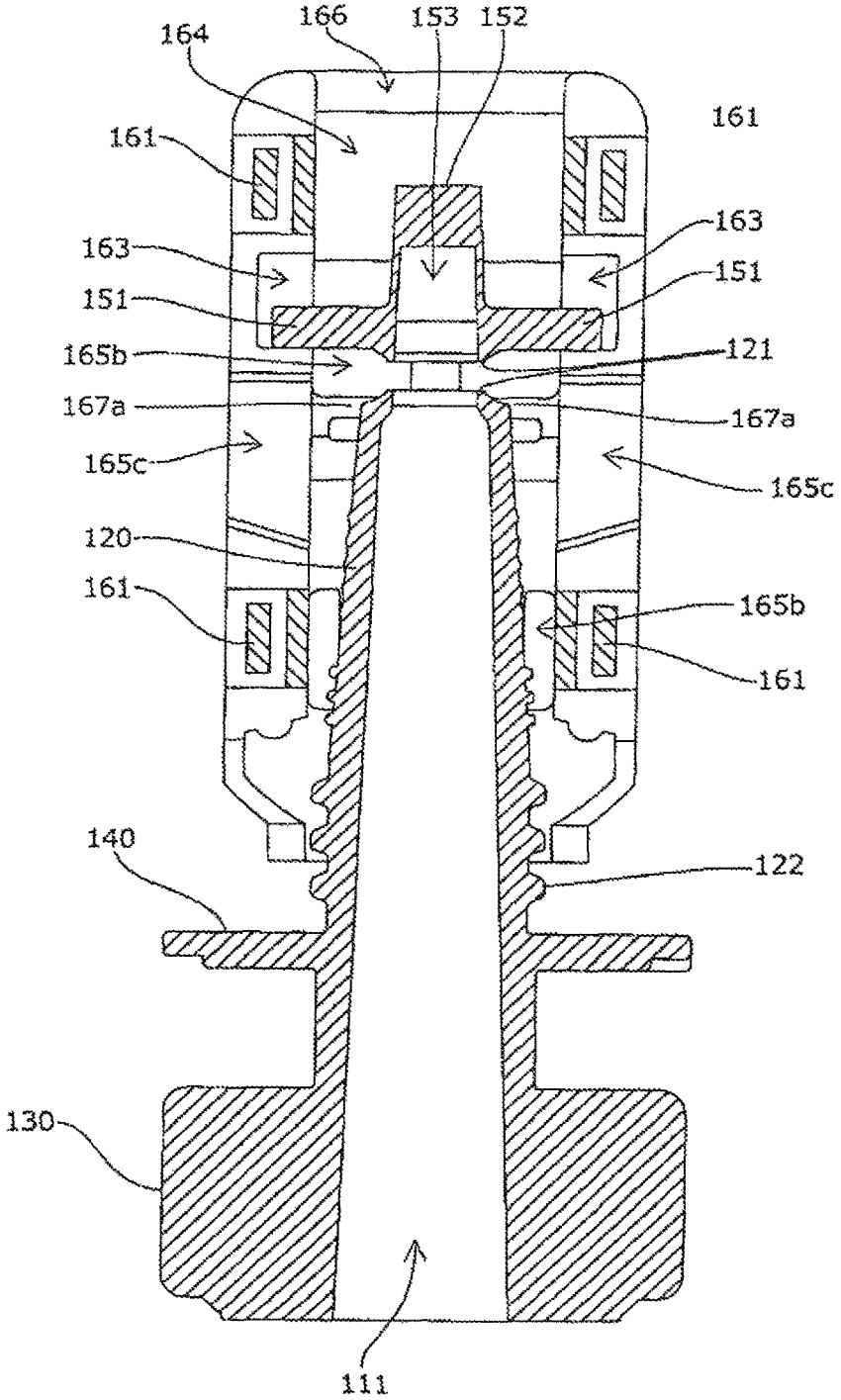
FIG. 10 is a side sectional view following removal of the break-off section of the break-off spout that is an exemplary embodiment of the present invention.

Then, as shown in FIG. 10, the pair of cover members 160 that have been secured to each other to form a unified cover are detached upwardly to produce a state in which tube 120, in which the tip of channel 111 is opened, is exposed to, allow use.

At this time, actuator arms 151 of break-off section 150 are enclosed in accommodation recesses 163 of cover members 160 in each of the peripheral directions and vertical directions. As a result, break-off section 150 is not separated from the pair of cover members 160 that have been secured to each other to form a unified cover, and break-off section 150 can therefore be easily detached. Accordingly, cover members 160 and break-off section 150 that are no longer needed are, easily discarded.

During the series of operations of breaking break-off section 150 and removing cover members 160 and break-off section 150 that has been broken, there is no contact between the user's fingers and tube 120 of spout main body 110, and tube 120 in which the tip of channel 111 is opened can therefore be exposed and placed in a usable state and can be used hygienically.

Although an exemplary embodiment of the present invention has been described based on the figures as shown above, the break-off spout of the present invention is suitable as the outlet of a pouch but can also be used in a receptacle other than a pouch, and a construction similar to the present invention may also be applied to a receptacle outlet other than a spout.

Although two connecting sections 171 are provided on the left and right sides in the above-described exemplary embodiment, connecting section(s) 171 may also be provided at one site or at three or more sites.

In addition, although connecting sections 171 are provided on flange section 140, connecting sections 171 may also be provided on any site of tube 120 as long as necessary sites of the upper portion of tube 120 including break-off section 150 are covered.

Still further, top opening 166 that is formed in the upper portion of the above-described exemplary embodiment may be replaced with the insertion port that allows insertion of a deformation means (not shown) from above and the opening shapes and areas of the top opening, insertion port, and cleaning fluid flow ports may take any form.

Further, although engagement parts 161 are provided at four points for securing together each of cover members 160 to form a unified cover at the time of assembly, the number of engagement parts 161 is not limited to four and known constructions can be adopted as the engagement construction.

Regarding engagement parts 161 of the above-described exemplary embodiment, it is assumed that once the pair of cover members 160 have been engaged, engagement parts 161 will subsequently be used and discarded without releasing engagement, and a construction for releasing engagement is therefore unnecessary. However, if a method of use is anticipated in which the pair of cover members 160 is subsequently to be separated, a construction may be added to release engagement.

For example, a case can be considered in which, at the time of use, the engagement of engagement parts 161 of cover members 160 is first released and break-off section 150 alone is separated to expose and enable the use of tube 120 in which the tip of channel 111 is opened, and then when use is discontinued, engagement parts 161 of cover members 160 are again engaged for use as a cover.

When this type of use is anticipated, connecting sections 171 may take the form of hinges that are not broken and a configuration is not necessary in which actuator arms 151 of break-off section 150 are enclosed in accommodation recesses 163 of cover members 160 in the peripheral and vertical directions.

In addition, pressure ribs 167*a*, pressure ribs 167*b*, stepped sections 162, and screw section 122 act as proximate protruding parts, but a portion of these may be omitted. Further, a rib-shaped protruding wall in which protrusions are provided that function as the proximate protruding parts may further be provided in other parts. When there is lithe possibility of damage during storage and transport after assembly and up to use, the proximate protruding parts themselves may be omitted.

Although a number of exemplary embodiments have been described as shown hereinabove regarding the break-off spout of the present invention, the present invention is not limited to these exemplary embodiments and is obviously open to various modifications within a scope that does not depart from the technical gist of the invention. Of course, various configurations can be adopted both for a pouch having a spout that is provided with this break-off spout and for the method of production.

In addition, based on the exemplary embodiments disclosed in this specification, the present invention can be provided in each of the following aspects.

The first aspect of the present invention is a break-off spout comprising:

a spout main body having a tube having a channel that passes through its center and a break-off section that is formed at a tip of the tube via a weakened section and that is integrated with the tube, a tip of the channel being closed by the break-off section; and a cover that covers an outer periphery of the tube of the spout main body at a tip side of the tube; wherein a protruding annular section is provided at a tip side of the break-off section;

a through-hole is formed in the annular section, wherein the through-hole communicates with the channel and is open at a tip side of the annular section;

the cover consists of a pair of cover members that are formed in a state in which the cover members are divided into left and right parts, and each of the cover members is integrated with the spout main body via a hinge section that is provided below the weakened section;

the pair of cover members are both provided with engagement parts that mutually engage and secure with each other, and the cover members are formed in a shape to cover a portion of the spout main body when cover members are folded upward and secured to each other to form a unified cover, the portion being above the hinge sections and including the break-off section; and insertion ports are provided at tip sides of the pair of cover members, wherein the insertion ports allow insertion of deformation means that deforms the annular section and blocks the through-hole.

A second aspect is a break-off spout according to the break-off spout of the first aspect in which the insertion ports are open on outer side surfaces of the pair of cover members.

A third aspect is a break-off spout according to the break-off spout of the first or second aspect in which the pair of cover members have cleaning fluid flow ports below the insertion ports.

A fourth aspect is a break-off spout according to the break-off spouts of any of the first to third aspects in which a proximate protruding part that comes into contact or proximity is provided on an outer surface of the tube and/or inner surfaces of the cover in members below the weakened section of the spout main body; and the cover members are formed in shapes to avoid contact with the break-off section when the cover members are secured to each other to form a unified cover.

A fifth aspect is a break-off spout according to any of the first to fourth aspects in which the hinge sections are connecting sections that can detach and separate the spout main body from the cover members.

A sixth aspect is a break-off spout according to the break-off spouts of any of the first to fifth aspects in which the break-off section of the spout main body has a pair of actuator arms that extend in a direction orthogonal to the channel; and accommodation recesses are provided on inner surfaces of the cover members, wherein the accommodation recesses accommodate the pair of actuator arms when the cover members are secured to each other to form a unified cover.

A seventh aspect is a break-off spout according to the break-off spout of the sixth aspect in which the accommodation recesses are formed in a shape to enclose the actuator arms with gaps in peripheral and vertical directions of the spout main body when the cover members are secured to each other to form the unified cover.

An eighth aspect is a break-off spout according to any of the first to seventh aspects in which the spout main body consists of the tube having the channel, an attachment section that is attached to a receptacle and a flange section that is provided in an upper vicinity of the attachment section; and the hinge sections are provided on the flange section.

A ninth aspect is a pouch having a spout that is made up from a plurality of sheets that are sealed at edges and formed in a bag shape and having a spout as an outlet for contents, wherein the spout is the break-off spout according to any of the first to eighth aspects.

A tenth aspect is a method of producing the pouch having the spout according to the aspect nine, wherein deformation means is inserted from the insertion port in order to deform the annular section and block the through-hole after cleaning inside the channel of the break-off spout.

An eleventh aspect is a method of producing the pouch having the spout according to the tenth aspect of the method of producing the pouch having the spout in which one of bonding parts between the break-off spout and a plurality of sheets that make up the pouch is bonded before cleaning inside the channel of the break-off spout, and remaining bonding parts are bonded after cleaning inside the channel of the break-off spout.

A twelfth aspect is a method of producing the pouch having the spout according to the eleventh aspect of the method of producing the pouch having the spout in which at a same time as bonding the remaining bonding parts, deformation means is inserted from the insertion port in order to deform the annular section and block the through-hole.

A twelfth aspect is a method of producing the pouch having the spout according to the tenth to twelfth aspects of the method of producing the pouch having the spout in which an outer surface of the spout main body and inner surfaces of the cover are cleaned through the insertion port after packing contents in the pouch.

A fourteenth aspect is a production method of a food or beverage that is packed in a pouch having a spout in which a food or beverage is packed in the pouch having a spout of the ninth aspect.

A fifteenth aspect is a method of producing a food or beverage in a pouch having a spout in which a food or beverage is packed in a pouch having a spout that is produced according to the tenth to thirteenth aspects of the method of producing a pouch having a spout.

A sixteenth aspect is a food or beverage in a pouch having a spout that is produced by the production method of the fourteenth or fifteenth aspects.

A seventeenth aspect is a food or beverage in a pouch having a spout in which a food or beverage in a pouch having a spout of the sixteenth aspect is a liquid food in a pouch having a spout.

Each of the above-described aspects exhibits the effects described hereinbelow.

According to the break-off spout of the first aspect, a pair of cover members is integrated with the spout main body via hinge sections that are provided below the weakened section. As a result, no force is applied to the break-off section or the weakened section when the pair of cover members are bent upward to engage with each other at the time of assembly, whereby damage to the weakened section is prevented and sealing performance is not lost.

In addition, the cover members are formed in a shape to cover a portion of the spout main body when cover members are folded upward and secured to each other to form a unified cover, the portion being above the hinge sections and including the break-off section. In this way, direct force is not applied from the outside upon the break-off section or weakened section at the time of transport or storage and damage to the weakened section due to unintentional external force can be prevented.

Still further, at a tip side of the annular section, a through-hole that communicates with the channel and that is open at a tip side of the annular section is formed and a protruding annular section is provided. Insertion ports are provided at tip sides of the pair of cover members, wherein the insertion ports allow insertion of deformation means that deforms the annular section and blocks the through-hole. By means of this configuration, the through-hole can be blocked following the completion of all processes after production, thus allowing cleaning of the interior of the spout to be carried out easily, and further, thus allowing closing of the through-hole after contents have been packed to enable packing to be carried out without leaving any space in the spout.

In addition, because the annular section is also covered by the cover, the protruding annular section is not subjected to direct force, and damage to weakened sections due to unintentional external force can therefore be prevented.

According to the break-off spout of the second aspect, the annular section can be deformed from the side direction and the through-hole can be blocked because the insertion, ports are open on outer side surfaces of the pair of cover members, whereby the through-hole can be more reliably blocked.

According to the break-off spout of the third aspect, the inclusion of cleaning fluid flow ports below the insertion port allows easy cleaning of the outer surface of the tube after the annular section is deformed and the through-hole is blocked, whereby the break-off spout can be used more hygienically.

According to the break-off spout of the fourth aspect, a proximate protruding part is provided that comes into contact with or proximity to an outer surface of the tube and/or inner surfaces of the cover members below the weakened section of the spout main body. Accordingly, a state can be achieved in which the pair of cover members that are secured to each other to form a unified cover are secured firmly or with virtually no movement to the spout main body, and the break-off section and weakened section therefore do not come into contact with the cover members.

In this way, even should external force be applied to the cover members during transport or storage, no force is conveyed to the break-off section and weakened section, and damage to the weakened section due to unintentional external force can be reliably prevented.

According to the break-off spout of the fifth aspect, the spout main body and cover members are connected by connecting sections that can be detached and removed, and as a result, the cover members can be easily removed by breaking the connecting sections at the time of use, resulting in an improvement in convenience.

Further, the chance of the user's fingers touching the spout main body can therefore be reduced, thereby enabling hygienic use.

According to the break-off spout of the sixth aspect, the break-off section has actuator arms that extend in directions orthogonal to the channel and, as a result, when the break-off section is twisted to break the weakened section for removal at the time of use, a large force can be applied and the break-off section can be easily detached, resulting in improved convenience.

In addition, the provision of accommodation recesses that accommodate the actuator arms in the inner surfaces of the cover members, enables a state in which there is no contact with the actuator arms when the cover members are secured together to form a unified cover, and as a result, even should external force be applied to the cover members at the time of transport or storage, no force is conveyed to the break-off section and weakened section, and damage to the weakened section due to unintentional external force can be reliably prevented.

According to the break-off spout of the seventh aspect, the action of removing the cover members at the time of use simultaneously twists the actuator arms that are accommodated within the accommodation recesses of the cover, members, whereby the break-off section can be easily removed for an improved convenience.

In this way, the chance of the user's fingers touching the spout main body can therefore be reduced, thereby enabling hygienic use.

Still further, the break-off section that has been detached is not separated from the cover members as the actuator arms remain accommodated in the accommodation recesses, whereby the process of disposing of the now unnecessary cover members and break-off section is facilitated.

According to the break-off spout of the eighth aspect, the entire tube above the flange section of the spout main body is covered by the cover members that have been secured to each other to form a unified cover, and the entire tube can therefore be protected during transport and storage, and problems during use that arise from damage to the outer surface of the tube can be prevented.

In addition, because there is a high degree of freedom of setting the distance in the radial direction from the channel center of the spout main body to the hinge sections, the cover members can be set in a functionally ideal form.

According to the pouch having a spout of the ninth aspect, the spout interior can be subjected to cleaning after production, and as a result, no microbes or extraneous matter will remain inside, and the pouch having a spout can be made hygienic.

Further, because the contents can be packed from the spout, there is no need for special configurations or steps for packing contents in the pouch. As a result, there are fewer limitations on the shape of the pouch and there are fewer limitations during production.

Still further, by closing the through-hole after packing the contents, packing can be carried out without leaving any space in the spout.

According to the production method of the pouch having a spout of the tenth aspect, contents can be packed after cleaning the interior of the spout following production, and as a result, a hygienic pouch having a spout can be produced without any microbes or extraneous matter remaining inside the spout.

According to the production method of the pouch having a spout of the eleventh aspect, cleaning of the pouch interior at the same time as cleaning of the spout interior enables hygienic usage without any microbes or extraneous matter remaining inside the pouch.

According to the production method of the pouch having a spout of the twelfth aspect, production and assembly are facilitated by the simplification of the production steps of the pouch.

According to the production method of the pouch having a spout of the thirteenth aspect, cleaning of the outer surface of the spout main body and the inner surfaces of the cover after packing the contents in the pouch enables sufficient cleaning of content that has adhered to the outside of the spout and pouch and further enables hygienic use.

According to the production method of a food or beverage in the pouch having a spout of the fourteenth aspect, a hygienic food or beverage can, be produced by packing the food or beverage in the pouch having a spout of the ninth aspect.

According to the production method of the and or beverage in a pouch having a spout of the fifteenth aspect, packing the food or beverage in the pouch having a spout that was produced according to any one of the production methods of the tenth to thirteenth aspects enables production of hygienic food or beverage.

According to the sixteenth aspect, a hygienic food or beverage in a pouch having a spout can be provided.

According to the seventeenth aspect, a hygienic liquid food in a pouch having a spout can be provided.

This application claims the benefits of priority based on Japanese Patent Application No. 2013-182327 filed on Sep. 3, 2013 and incorporates by reference all of the disclosures therein.

What is claimed is:

1. A break-off spout comprising:

a spout main body having a tube having a channel that passes through its center and a break-off section that is formed at a tip of the tube via a weakened section and that is integrated with the tube, a tip of the channel being closed by the break-off section; and a cover that covers an outer periphery of the tube of the spout main body at a tip side of the tube; wherein a protruding annular section is provided at a tip side of the break-off section;

a through-hole is formed in the annular section, wherein the through-hole communicates with the channel and is open at a tip side of the annular section;

the cover consists of a pair of cover members that are formed in a state in which the cover members are divided into left and right parts, and each of the cover members is integrated with the spout main body via a hinge section that is provided below the weakened section;

the pair of cover members are both provided with engagement parts that mutually engage and secure with each other, and the cover members are formed in a shape to cover a portion of the spout main body when cover members are folded upward and secured to each other to form a unified cover, the portion being above the hinge sections and including the break-off section; and insertion ports are provided at tip sides of the pair of cover members, wherein the insertion ports allow insertion of deformation means that deforms the annular section and blocks the through-hole.

2. The break-off spout according to claim 1, wherein the insertion ports are open on outer side surfaces of the pair of cover members.

3. The break-off spout according to claim 1, wherein the pair of cover members have cleaning fluid flow ports below the insertion ports.

4. The break-off spout according to claim 1, wherein:

a proximate protruding part that comes into contact or proximity is provided on an outer surface of the tube and/or inner surfaces of the cover members below the weakened section of the spout main body; and the cover members are formed in shapes to avoid contact with the break-off section when the cover members are secured to each other to form a unified cover.

5. The break-off spout according to claim 1, wherein the hinge sections are connecting sections that can detach and separate the spout main body from the cover members.

6. The break-off spout according to claim 1, wherein:

the break-off section of the spout main body has a pair of actuator arms that extend in a direction orthogonal to the channel; and accommodation recesses are provided on inner surfaces of the cover members, wherein the accommodation recesses accommodate the pair of actuator arms when the cover members are secured to each other to form a unified cover.

7. The break-off spout according to claim 6, wherein the accommodation recesses are formed in a shape to enclose the actuator arms with gaps in peripheral and vertical directions of the spout main body when the cover members are secured to each other to form the unified cover.

8. The break-off spout according to claim 1, wherein:

the spout main body consists of the tube having the channel, an attachment section that is attached to a receptacle and a flange section that is provided in an upper vicinity of the attachment section; and the hinge sections are provided on the flange section.

9. A pouch made up from a plurality of sheets that are sealed at edges and formed in a bag shape and having a spout as an outlet for contents, wherein the spout is the break-off spout according to claim 1.

10. A method of producing the pouch having the spout according to claim 9, wherein deformation means is inserted from the insertion port in order to deform the annular section and block the through-hole after cleaning inside the channel of the break-off spout.

11. The method of producing the pouch having the spout according to claim 10, wherein, one of bonding parts between the break-off spout and a plurality of sheets that make up the pouch is bonded before cleaning inside the channel of the break-off spout, and remaining bonding parts are bonded after cleaning inside the channel of the break-off spout.

12. The method of producing the pouch having the spout according to claim 11, wherein, at a same time as bonding the remaining bonding parts, deformation means is inserted from the insertion port in order to deform the annular section and block the through-hole.

13. The method of producing the pouch having the spout according to claim 10, wherein an outer surface of the spout main body and inner surfaces of the cover are cleaned through the insertion port after packing contents in the pouch.

14. A method of producing a food or beverage in a pouch having a spout, wherein a food or beverage is packed in the pouch having the spout according to claim 9.

15. A method of producing a food or beverage in a pouch having a spout, wherein a food or beverage is packed in a pouch having a spout that is produced according to the method of producing a pouch having a spout in claim 10.

16. A food or beverage in a pouch having a spout that is produced according to the method in claim 14.

17. A food or beverage in a pouch having a spout, wherein the food or beverage in a pouch having a spout according to claim 16 is a liquid food in a pouch having a spout.

* * * * *